United States Patent [19]

Magyar et al.

[11] Patent Number: 4,903,796

[45] Date of Patent: Feb. 27, 1990

[54] REUSABLE QUICKLY ASSEMBLED AND QUICKLY KNOCKED DOWN WORK SUPPORTS, USED SINGLY AND WITH OTHERS FOR MANY PURPOSES AND CONVENIENTLY CARRIED AND STORED

[76] Inventors: William A. Magyar, 1121 6th St.; Jack R. Sloboden, 10844 NE. 68th #103, both of Kirkland, Wash. 98033

[21] Appl. No.: 254,428

[22] Filed: Oct. 6, 1988

[51] Int. Cl.[4] ..... B27B 21/00; B25H 1/06

[52] U.S. Cl. ..... 182/129; 182/183; 182/185; 182/224; 269/902

[58] Field of Search ..... 182/181–186, 182/224, 129; 269/902, 900

[56] References Cited

U.S. PATENT DOCUMENTS

| | | | |
|---|---|---|---|
| 1,408,675 | 3/1922 | Wimberg | 182/181 |
| 1,458,738 | 6/1923 | Teeken | 182/181 |
| 1,547,225 | 7/1925 | Marks | 182/182 |
| 2,198,956 | 4/1940 | Thielepabe | 182/181 |
| 2,410,330 | 10/1946 | Ashemfelter | 182/184 |
| 4,014,404 | 3/1977 | Jackson | 182/181 |
| 4,031,981 | 6/1977 | Spencer | 182/182 |
| 4,121,814 | 10/1978 | Prior | 269/902 |
| 4,298,096 | 11/1981 | Prior | 182/153 |
| 4,375,245 | 3/1983 | Schill | 182/182 |
| 4,457,399 | 7/1984 | Breisch | 182/185 |
| 4,492,354 | 1/1985 | Rice | 182/182 |
| 4,756,384 | 7/1988 | Maddox | 182/184 |

*Primary Examiner*—Reinaldo P. Machado
*Attorney, Agent, or Firm*—Roy E. Mattern, Jr.

[57] ABSTRACT

Work supports, which are quickly assembled and quickly knocked down, are used singly and with others, with and without accessories, for many purposes. When not in use, these work supports are conveniently carried and stored. Each work support has a pair of leg assemblies, wherein each leg has an overall planar triangular shape made of continuous pipe, arranged, via bending, with a horizontal lower pipe side for ground or floor contact, and two upstanding opposite slanting pipe sides, which are secured by welding to the underside of a large pipe. This larger pipe serves as a horizontal cross bar sleeve. Eac triangular planar shaped continuous pipe leg is positioned at a five degree cant with the horizontal cross bar sleeve. Also, each leg has two short length bracing pipes, each extending on a forty five degree angle between a respective upstanding opposite slanting pipe side and the underside of the larger horizontal cross bar sleeve, and so welded, to increase the strength and to eliminate flexing of each leg assembly of each work support. Each horizontal cross bar sleeve has a threaded hole to receive a threaded locking bolt, and non threaded aligned holes to receive a drop in depending threaded bolt, which integrally supports above an integral channel section, which is ready to receive a piece of two by four or two by six lumber, etc. at one of many selected angles. Moreover, each work support has a horizontal pipe of selected length, or a telescoping set of horizontal pipes, which are insertable at their respective ends into respective horizontal cross bars, and locked upon turning the locking bolts to complete the basis assembly of one work support. The bottom of each horizontal lower pipe side is coated with a non-scuffing, non-slipping, and non-conducting insulating material.

16 Claims, 5 Drawing Sheets

FIG. 9
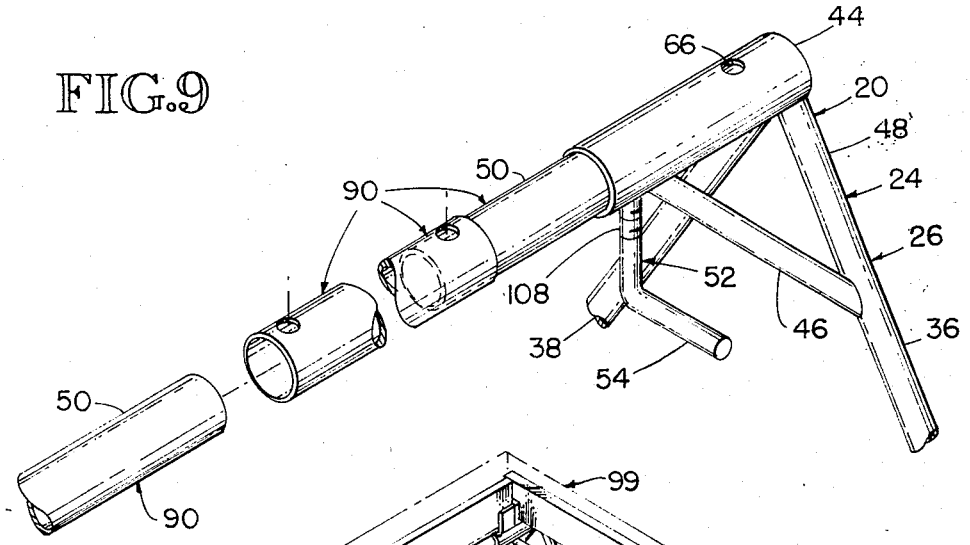
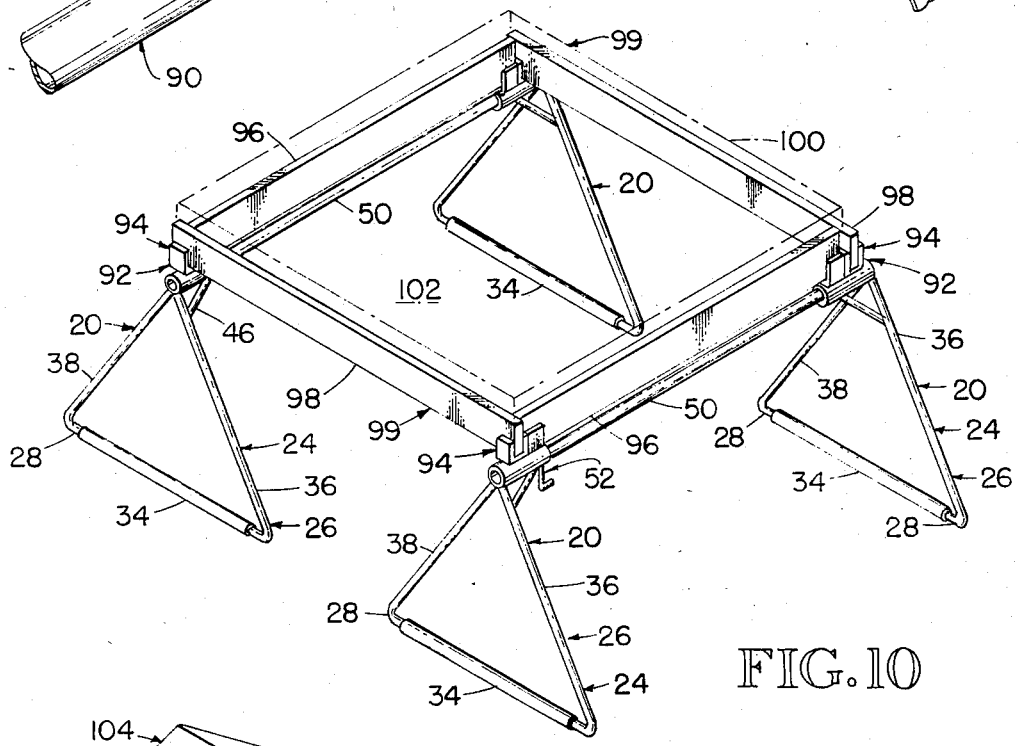
FIG. 10
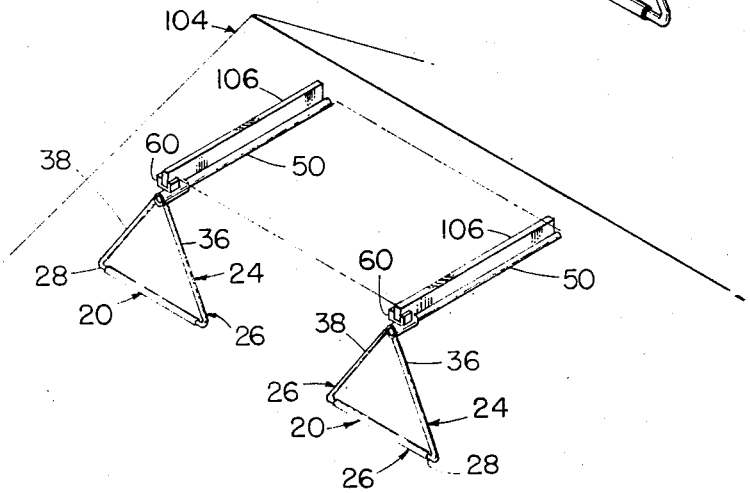
FIG. 11

REUSABLE QUICKLY ASSEMBLED AND QUICKLY KNOCKED DOWN WORK SUPPORTS, USED SINGLY AND WITH OTHERS FOR MANY PURPOSES AND CONVENIENTLY CARRIED AND STORED

BACKGROUND

Work supports have always been needed and will continue to be needed, whenever a professional or amateur worker needs to support materials he is working on, or needs to support himself to work at higher elevations. Most amateurs today buy small metal hinge units, which receive especially cut two by four lumber pieces, serving both as the legs and the horizontal cross member. There are also more expensive all metal leg members which are joined by a horizontally positioned two by four lumber piece.

Prior inventors have also disclosed their many work supports in United States patents, and some of these are referred to as follows:

In 1922, Anthony Wimberg, in his U.S. Pat. No. 1,408,675, illustrated and described his vise stand. At one end a cast member positioned a horizontal place to which a vise could be secured and three receiving spaces. Two of these spaces were threaded and received the threaded ends of supporting round pipe legs. The three receiving spaces received, via sliding, a horizontally positioned pipe, and a set screw kept them together. At the other end of this vise stand, the cast member positioned a curved receiver to receive larger members to be worked on. Also two threaded spaces were provided to receive the threaded ends of supporting round pipe legs, and a third horizontal space slidably received the other end of the horizontally positioned pipe. A set screw again was used to keep them together. This vise stand was a specialized work support centering on the positioning of the vise and one spaced support, for holding and positioning the ends of various materials, being held at least at one end in the vise.

In 1977, Edgar D. Jackson, in his U.S. Pat. No. 4,014,404, disclosed his saw horse using a horizontal cross member which was a two by four lumber piece. At each of the ends thereof, was a leg assembly made of elongated tubing defining a transverse base and two legs extending upwardly from the base.

In 1981, Herbert E. Prior in his U.S. Pat. No. 4,298,096 illustrated and described his convertible trestle leg assembly which supported a two by four lumber piece either on the two inch side or the four inch side, to serve as the horizontal member extending between the metal leg assemblies. The latter assemblies were pivoted and then locked by toggle linkage having an over-center locking device.

In 1984, John H. Breisch, in his U.S. Pat. No. 4,457,399 illustrated and described his work support unit, which is convertible between a work horse and a buck horse. There are three horizontal metal members. Two members at the top, each have a V shape in their midsection, and below them is one member which extends directly across between the end brackets, which support these three horizontal metal members. Moreover, atop the top two metal members is a transverse piece of lumber. Then depending from each end bracket are a pair of angularly positioned legs. With the lumber in place Mr. Breisch's work support is a work horse, and with the lumber removed he considers the work support to be a buck horse.

Other products are available on the market, and two of these products have the respective U.S. Pat. Nos. 2,198,956 and 4,121,814.

SUMMARY

Work supports are provided for the professional and amateur worker in respective sizes, with and without accessories, for use singly and with others to provide safe, strong, reliable, and comparatively low cost supports for them to use during many of their jobs of constructing, installing, repairing, and manufacturing. When the work supports must be stored or transported, they are conveniently quickly disassembled into smaller units which are easily handled and compactly arranged.

Each work support, fully manufactured from standard metal pieces, has a pair of leg assemblies. Each leg thereof has an overall planar triangular shape of continuous pipe, arranged, via bending, with a horizontal lower pipe side for ground or floor contact, and two upstanding opposite slanting pipe sides, which are welded to the underside of a larger pipe, serving as a horizontal cross bar sleeve. Each triangular planar shaped continuous pipe leg is positioned at a five degree cant with the horizontal cross bar sleeve to add to the overall stability. Also each leg has two short length bracing pipes, each extending on a forty five degree angle between a respective upstanding opposite slanting pipe side and the underside of the larger horizontal cross bar sleeve and welded, to thereby increase the strength of each leg assembly and to eliminate flexing of each leg assembly and therefore improve the reliable strength of the work support.

Each horizontal cross bar sleeve has a receiving space to receive an end of a horizontal pipe of selected length and smaller diameter, and a locking means to keep the inserted received end in place within the horizontal cross bar sleeve. With this horizontal pipe 50 inserted and locked at each end, the basic work support is assembled. The horizontal leg portions always rest on the ground, being first relatively rotatable with respect to the horizontal member, which is generally a pipe.

Each horizontal cross bar sleeve has vertically arranged and aligned holes to receive depending pins or shafts, of various accessories, which extend the usefulness of the basic work support. Top portions, having such depending shafts for sliding down into and through these aligned holes for subsequent support and rotatable mounting, are formed in various ways to accomplish the receiving, holding, and/or positioning of other materials, wood, metal or plastic, or other equipment. For example the top portion has: one or two channels to receive two by four, two by six, etc. lumber; a vee receiver for pipe or a log; or a horizontal assembly of a horizontal roller on which lumber or lengths of metal are movably rested.

On the horizontal pipe of selected length, a reel is mounted, or a bar clamp is mounted. This horizontal pipe is alternately available as a telescoping assembly with a locking means, thereby permitting the selectable length between the leg assemblies of work support.

The bottom of each lower pipe side of each leg assembly is preferably coated or covered with a non-scuffing, non-slipping, and non-conducting insulating material, to complete a work support which fully meets the needs of both the professional and amateur worker.

DRAWINGS

This reusable, quickly assembled, and quickly knocked down work support is shown, as assembled, used with other ones, disassembled, and used with accessories, in the drawings, wherein.

Figure 1:
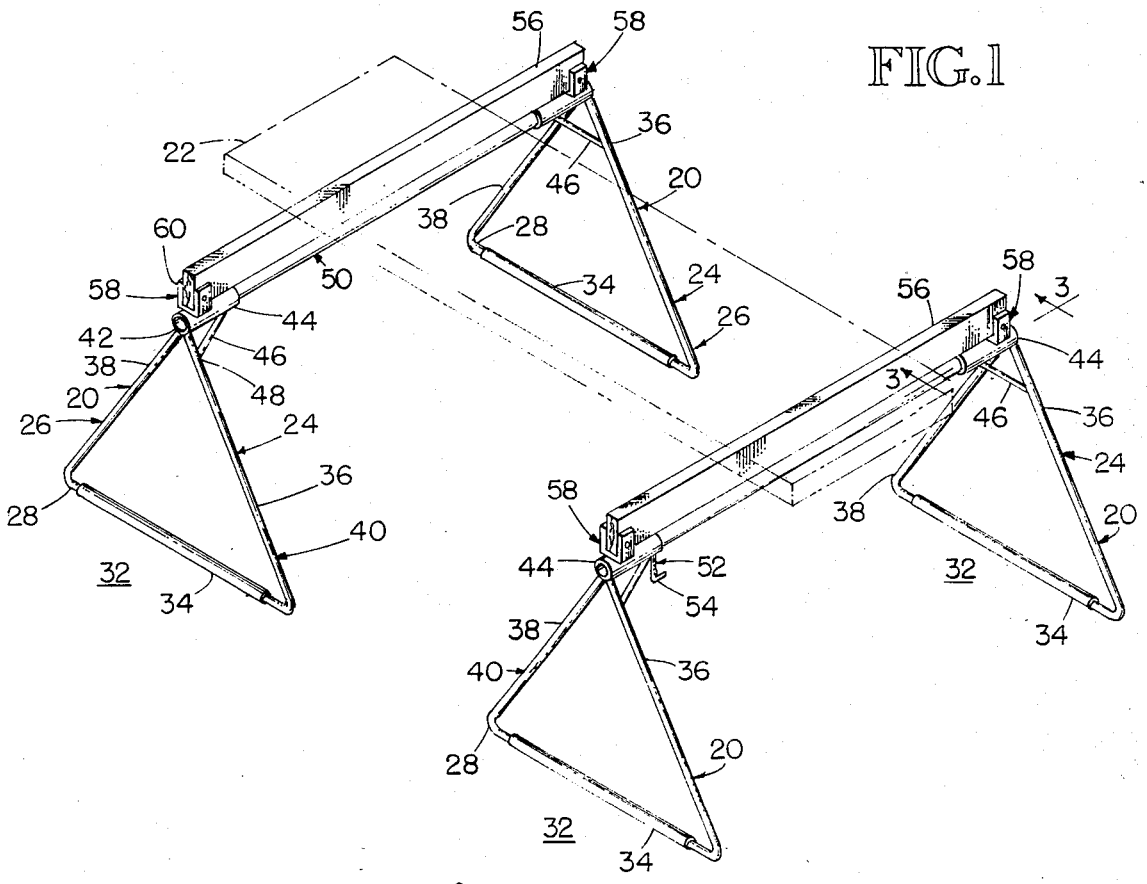
FIG. 1 is a perspective view of two of the assembled work supports spaced apart to support a wood door, the latter being shown in phantom lines.
Figure 2:
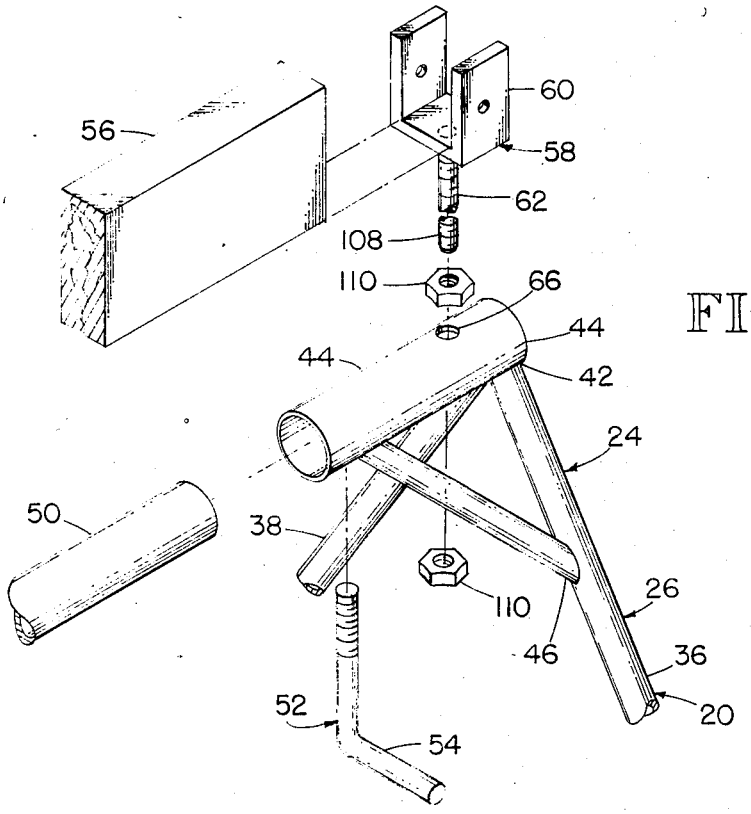
FIG. 2 is an exploded partial end view of one end of a work support indicating the various components and how they are assembled, such as the leg assembly, the longer linear horizontal member, the locking bolt, the upstanding receiving members with channel top receivers, and the piece of lumber.
Figure 7:
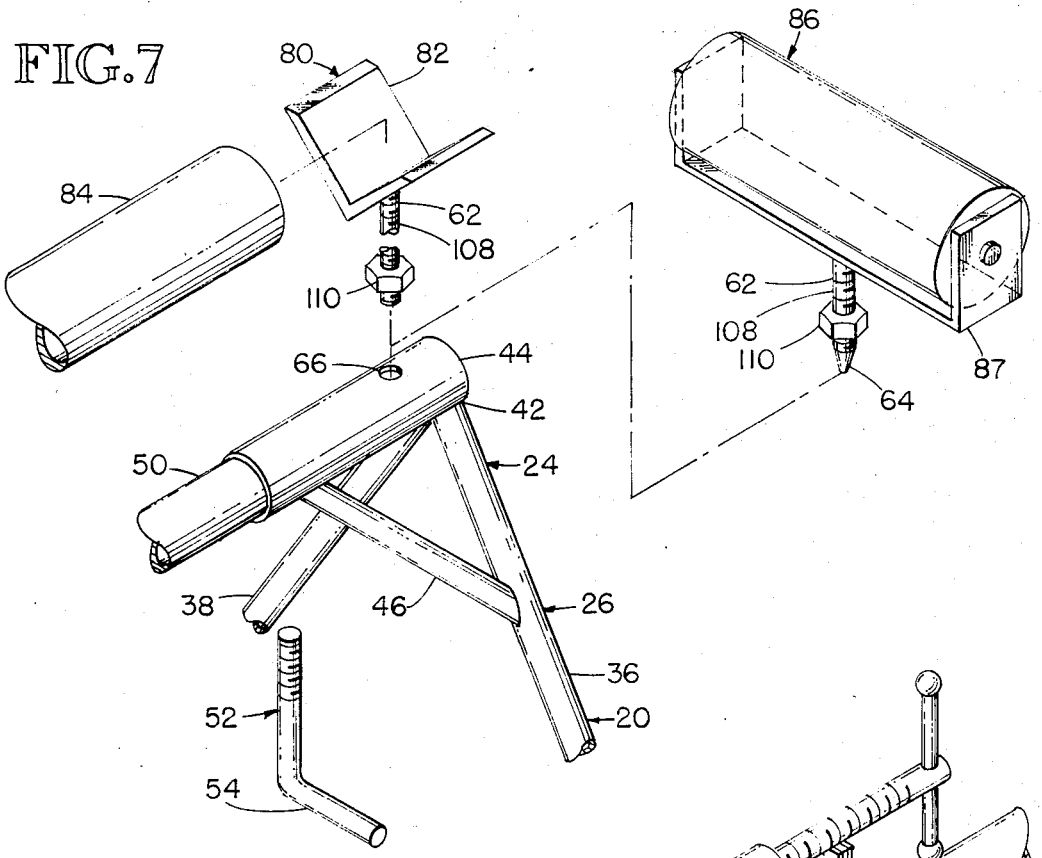
Figure 8:
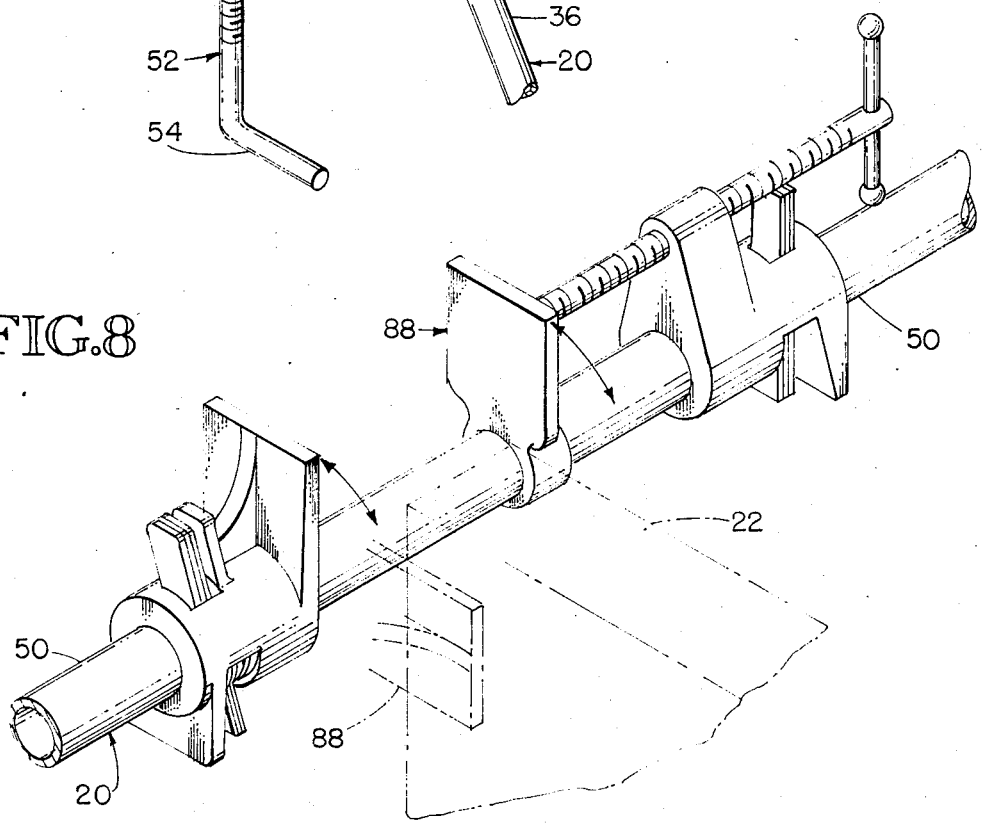

FIG. 7 is a partial perspective view, somewhat similar to FIG. 2, but showing how the work support is used, without including a piece of lumber, and how a V top upstanding receiving member is used to support an end of a piece of pipe on which work is to be performed, and how, alternately, a roller assembly on an upstanding receiving member is used to rollably support a piece of pipe or another member to be worked on;

FIG. 8 is a perspective view of the longer linear horizontal member of the work support on which a bar clamp has been mounted, to in turn hold another work piece, not shown;

FIG. 9 is a partial perspective view of portions of a work support to illustrate how the longer linear horizontal member is an assembly of telescoping members securable by using a locking bolt;

FIG. 10 is a perspective view, somewhat similar to FIG. 1, illustrating however, how double channel tops of the upstanding receiving members are used to support lumber pieces, which form a rectangular support frame for a plywood work platform, the latter being shown in phantom lines, or the rectangular support frame could be made of metal with a steel plate cover to create a welding table; and FIG. 11 is a perspective view of one work support which is used in connection with a portion of a building, such as a roof portion, or with a retaining wall, wherein the extending members are supported between the work support and, for example, the roof portion of a building.

DESCRIPTION OF THE PREFERRED EMBODIMENT AND ACCESSORIES THEREFOR

These work supports 20 used singly or with other work supports 20, or with other in place supports such as walls, and used with and without accessories, are shown throughout the figures of the drawings. In FIG. 1, two work supports 20 are illustrated as they are spaced apart and arranged to support material such as plywood 100, or a door 22, shown in phantom lines, so this door 22 may be worked on at this convenient work table height.

Each work support 20, has two leg assemblies 24, one at each end. Each leg assembly 24 has a near upright overall right leg 26 positioned on a five degree cant. Each overall leg 26 has a bottom or base portion 28, which is continuous to contact the ground 30 or a floor 32, and is preferably coated or covered on the underside thereof, with a non slipping, non scuffing and non conductive material 34. Each overall leg 26 has two continuous upstanding slanting together leg portions 36, 38, which complete a triangular pattern 40 of each overall leg 26. Preferably, each overall leg 26 is made of pipe and bent to form the triangular pattern 40.

The overall legs 26 are welded at the top 42 thereof, to the underside of a larger cross sectional member 44, which is preferably a cross bar sleeve 44. Then at least one diagonally placed and welded brace 46, at preferably a forty degree angle, extends from an upper portion 48 of a slanting leg portion 36, up to the underside of the cross bar sleeve 44. This brace 46 is preferably made of pipe, which is also used in making the overall leg 26. Preferably two such braces 46 are used.

Figure 3:
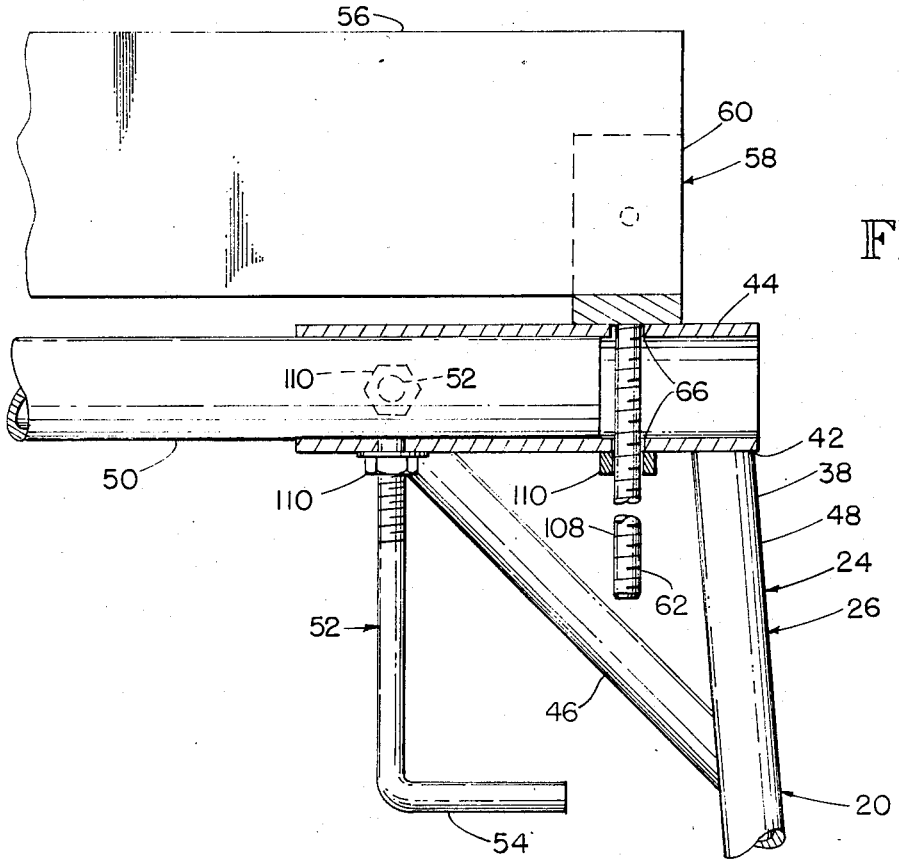
FIG. 3 is a partial side view, with portions removed, taken in reference to section line 3—3 of FIG. 1, to illustrate the assembly of the leg assembly, the longer linear horizontal member, the locking bolt, the upstanding receiving member, and the piece of lumber.

Extending between the leg assemblies 24 is a horizontal cross member 50, made of pipe, which is insertable at the ends thereof into the respective horizontal cross bar sleeves 44, as shown in FIGS. 1 and 2. Also, as shown in FIGS. 2 and 3, a threaded locking bolt 52, with a turning handle 54, is threaded through a threaded hole 56, formed in the cross bar sleeve 44, until it radially bears against the horizontal cross member 50, to then secure the end of the cross member 50 in place within the horizontal cross bar sleeve 44.

When wood members, such as the wood door 22, are to be supported, then a two by four or two by six lumber piece 56 is extended across between the leg assemblies 24 above the horizontal cross member 50. Two upstanding vertical members 58 are used to support the lumber piece 56. Each vertical member 58 has a channel shaped portion 60 above, and an integral depending rod portion 62 below, having a pointed end 64. The rod portion 62 is dropped down through aligned holes 66 made in the horizontal cross bar sleeve 44, as shown in FIGS. 2 and 3.

Figure 4:
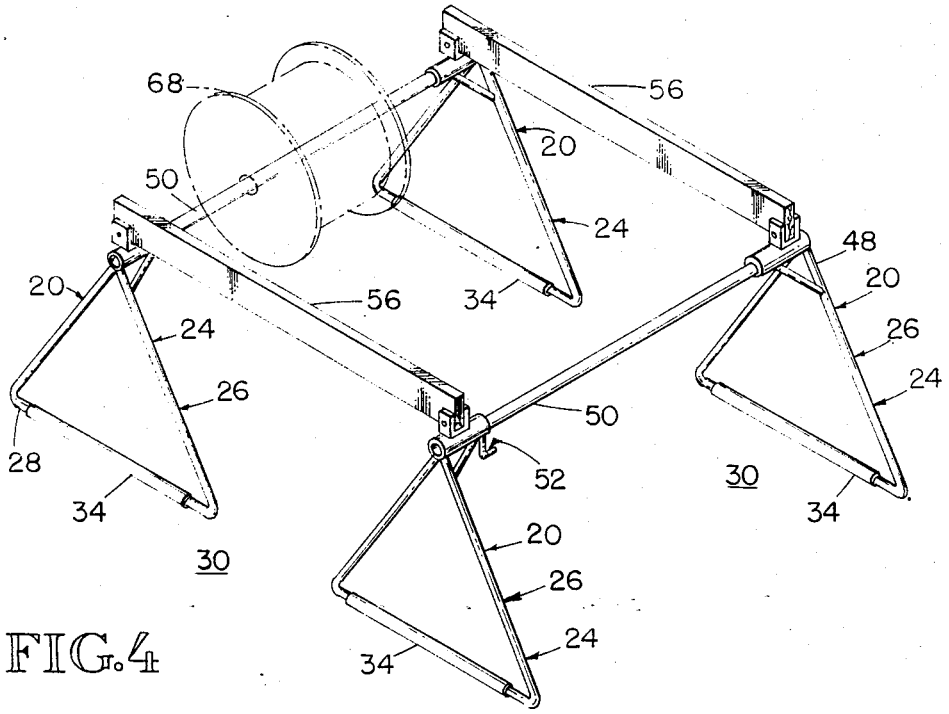
FIG. 4 is a perspective view, similar to FIG. 3; however, the lumber pieces used to support work projects, are extended longitudinally between the work supports, after the rotation of their upstanding receiving members, and, in phantom lines, an electrical conduit reel is illustrated.

In FIG. 4, these upstanding vertical members 58 are rotated ninety degrees and the channel shaped portions 60 receive two by four or two by six members, which are extended between the work supports 20. Also shown in phantom lines in FIG. 4, is a reel 68, which is rotatably supported on a cross member 50. Such reels 68 could contain electrical cable, not shown.

Figure 5:
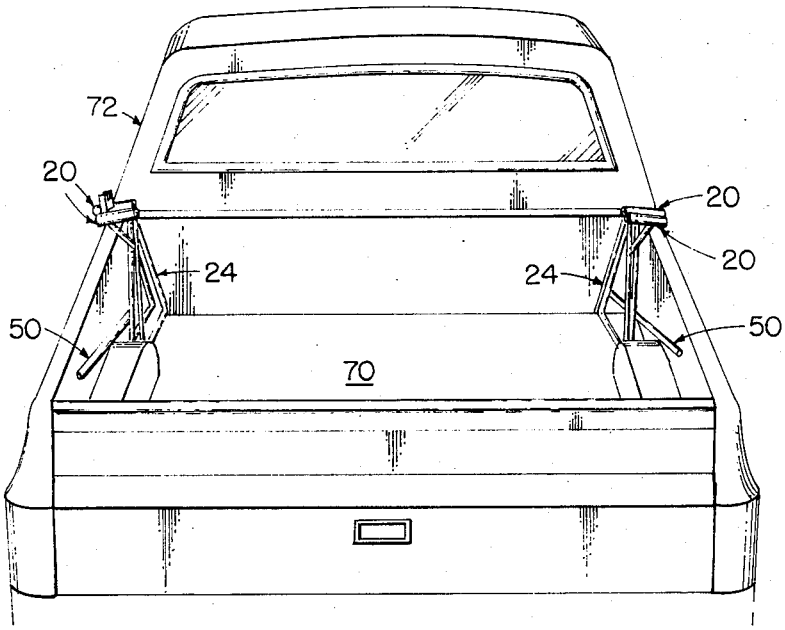
FIG. 5 is a perspective view, illustrating how two work supports, which are disassembled, are stored conveniently in a pickup truck.
Figure 6:
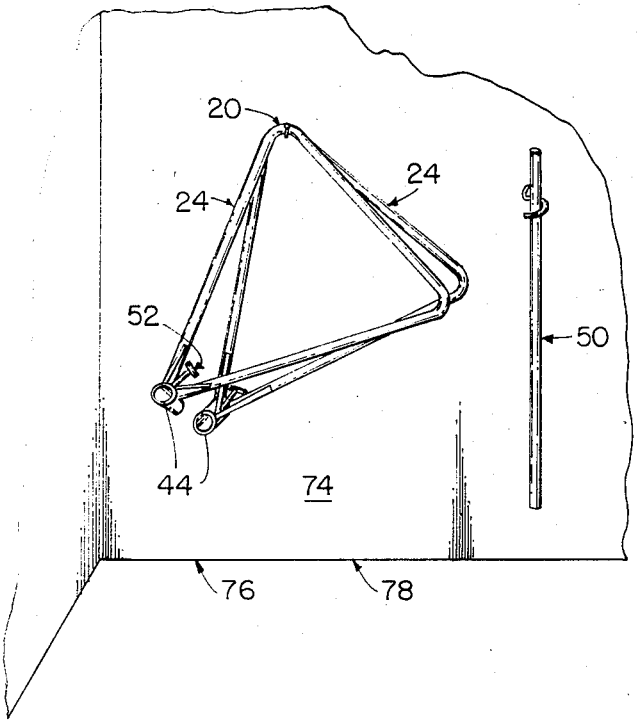
FIG. 6 is a perspective view, showing how a work suport which is dissassembled, is conveniently supported on a wall.

When the work supports 20 are no longer needed at a work location, they are quickly and conveniently disassembled. They are easily stored in a bed 70 of a pickup truck 72, as shown in FIG. 5. Also they are readily stored on the wall 74 of a storage area 76 of a dwelling 78, as shown in FIG. 6.

Other accessories are provided to extend the usefulness of the work supports 20. As shown in FIG. 7, another upstanding vertical member 80 has a vee shaped top portion 82 to position a larger cross sectional member 84, such as a large pipe, as illustrated, or a log, not shown. Again an integral depending rod 62 with a pointed end 64 is used. In place of these upstanding members 58, 80, a roller assembly 86, with its frame 87 and an integral depending rod 62, with a pointed end 64, is used to rollably support a larger cross sectional member 84.

Bar clamps 88 are positioned on the horizontal cross member 50, as shown in FIG. 8. Thereafter various types of pieces of material, not shown, may be clamped in place, while being worked on.

The horizontal cross member 50 is made of selected lengths, for example, of pipe. Also a telescoping assembly of pipes 90 is used and a selectable length thereof is maintained upon tightening the respective locking bolts 52, as shown in FIG. 9.

There will be times when at least two work supports are to be used to create a table on a work platform. Preferably, when this is to occur, the upstanding vertical members 92 have double channel tops 94, above their respective depending integral rods 62 with pointed ends 64. Then, as shown in FIG. 10, the two by four or two by six lumber pieces 96, 98 are held with their respective ends positioned in these double channel tops 94. As so arranged these two lumber pieces 96 and two lumber pieces 98 form a horizontal plane frame work 99 to support, for example, a sheet of plywood 100, to thereby create a table or a work platform 102.

There will also be times when one work support 20 will be used in conjunction with some existing support, such as a retaining wall, not shown, or a roof ridge structure 104, as shown in FIG. 11. Then the lumber pieces 106 which are used are extended between the upstanding vertical members 58 or 92, positioned on the work supports 10, and the roof ridge structure 104.

Material Sizes Selected in Reference to One Specific Embodiment

The legs 26 of one specific embodiment are made of one half inch diameter schedule forty pipe. The braces 46 are also made of one half inch diameter schedule forty pipe. Each cross bar sleeve 44 is made of one and five sixteenths inch diameter pipe, four and one half inches long. The horizontal cross member 50 is made of three quarter inch diameter schedule forty pipe.

Angular Positioning of Legs 26, and Varying the Height of the Upstanding Vertical Members, Varying the Length of the Cross Member and Members Between Work Supports, and the Expendability of Lumber Pieces When assembling the work supports 20, especially on the ground 30, which generally is not level like an inside floor 32, the bottom 28 of each leg 26 is positioned, while being as freely rotatable as possible, to make the best overall ground contact. Then the respective threaded locking bolt 52 is tightened. Following this procedure, at each leg assembly 24 of each work support 20, results in the very stable positioning of the work support 20 at the selected work location.

Thereafter, when using the various upstanding vertical members 58, 80, 86, and 94, height adjustments of them are made, when the depending rod portions 62 are threaded 108, as preferred, and a vertical position determining nut 110 is used to determine the effective height adjustment of each particular depending rod 62, as shown in FIG. 7.

Instead of using a threaded depending rod 62 and nut 110, if the depending rod 62 is not threaded, then a positioning collar, not shown, held at a designated level by a set screw, could be used.

By varying the length of the cross member, by selection of different length members, or adjusting telescoping cross members, the overall length is adjusted to fit the job requirements from hallway work spaces to outdoor spaces.

Also the two by four, two by six, two by eight, etc. lumber pieces may be selected at different lengths between work supports. Therefore the work rest platform, or personnel supporting platform may be made for different area requirements.

Also in regard to the lumber pieces, if during work projects operating saws might pass through portions of the lumber pieces, they subsequently are conveniently replaced. It is to be remembered that lumber pieces extending between the leg assemblies are always structurally backed up by the metal cross member.

Many More Uses Will be Undertaken of These Work Supports

The drawing and descriptions indicate the many uses already undertaken of these work supports 20, with and without accessories, and used singly and with others. To meet an anticipated demand these work supports 20 will be made in larger sizes having an elevation higher than work table heights. Such larger and higher work supports will serve, for example, as work platforms, often replacing in part or completely on some jobs, the function of some scaffolding.

Whatever size and whatever function is invoked, these work supports 20 will always safely support the objects being worked on, and/or the personnel working from platforms supported by these work supports 20.

We claim:

1. Work supports, quickly assembled and quickly knocked down, used singly or with others, with and without accessories for many work supporting purposes, comprising:

(a) a pair of leg assemblies, wherein:

(i) each leg has an overall planar triangular shape made of a continuous linear member, arranged, via bending, to have a horizontal lower linear member side for ground or floor contact, and two upstanding oppositely slanting linear member sides;

(ii) a larger cross sectional area linear horizontal member secured to the two upstanding oppositely slanting linear member sides; and (iii) two short length linear bracing members, each extending at an angle between a respective upstanding opposite slanting linear member side and the underside of the larger cross sectional area linear horizontal member; and (b) a longer linear horizontal member having a different cross sectional area removably securable at the ends thereof, to the respective larger cross sectional area linear horizontal members, which are secured to the respective two upstanding oppositely slanting linear member sides of the respective legs, thereby spacing and positioning the respective legs of this work support and completing a work support.

2. Work supports, as claimed in claim 1, wherein each larger cross sectional area linear horizontal member of each leg assembly has a threaded hole, and has a threaded bolt, which is turned within the threaded hole to secure the longer linear horizontal member having the different cross sectional area to this respective larger cross sectional area linear horizontal member.

3. Work supports, as claimed in claims 1 or 2, wherein each larger cross sectional area linear horizontal member of each leg assembly has receiving space to slidably and rotatably receive a depending part of an upstanding receiving member to receive and to position an extending piece of lumber or piece of metal.

4. Work supports, as claimed in claim 3, having upstanding receiving members, each having a top portion and a bottom portion, and via their top portion, receiving and positioning an extending piece of lumber or an extending piece of metal, and via their depending bottom portion being rotatably held in the receiving space of the larger cross sectional area linear horizontal member of a respective leg assembly.

5. Work supports, as claimed in claim 4, wherein the top portion of the upstanding receiving members has a channel shaped receiving and positioning portion to fit an extending piece of lumber or an extending piece of metal.

6. Work supports, as claimed in claim 4, wherein the top portion of the upstanding receiving members has two channel shaped receiving and positioning portions arranged at right angles to one another to fit extending pieces of lumber or extending pieces of metal which in turn are supported at right angles to one another.

7. Work supports, as claimed in claims 1 or 2, wherein each larger cross sectional area linear horizontal member of each leg assembly has a receiving space to slidably and rotatably receive a depending part of an upstanding V-shaped receiving member to receive and to position an extending piece of pipe or a log.

8. Work supports, as claimed in claims 1 or 2, wherein each larger cross sectional area linear horizontal member of each leg assembly has a receiving space to slidably and rotatably receive a depending part of an upstanding horizontal roller assembly to rollably support an extending piece of wood, log, pipe or metal.

9. Work supports, as claimed in claims 1 or 2, wherein the longer linear horizontal member having a different cross sectional area, is a telescoping members assembly adjustable to selectable lengths, and thereby selectably spacing and positioning the respective legs of this work support.

10. Work supports, as claimed in claim 9, wherein the telescoping members assembly has a combination of a threaded hole and a threaded bolt, and the latter is turned within the threaded hole to secure the telescoping members at their selected overall length.

11. Work supports, as claimed in claims 1 or 2, wherein a bar clamp is installed on the longer linear horizontal member having the different cross sectional area.

12. Work supports, as claimed in claims 1 or 2, wherein a reel is installed on the longer linear horizontal member having the different cross sectional area.

13. Work supports, as claimed in claims 1 or 2, wherein the linear members are derived from pipe members and the respective larger, smaller, different diameters provide interfitting, overlapping, telescoping of the respective components of this work support.

14. Work supports, as claimed in claims 1 or 2, wherein the legs are secured to the larger cross sectional area linear horizontal member at a cant angle to increase the stability of the work support.

15. Work supports, as claimed in claims 1 or 2, wherein the horizontal side of each leg along the bottom thereof, where contact is made with the ground or floor, is covered with a material which will prevent scuffing, slipping, and electrical shock.

16. Work supports, as claimed in claim 1, wherein the leg assemblies are individually rotatably relative to the longer linear horizontal member to fully contact the ground, so the leg assemblies are thereby rotatably self leveling at the larger cross sectional area linear horizontal member.

* * * * *